United States Patent [19]

Kowalski

[11] Patent Number: 4,543,728

[45] Date of Patent: Oct. 1, 1985

[54] ARCHERY BOW SIGHT

[76] Inventor: Robert J. Kowalski, 540 Old Plank Rd., Rte. 8, Butler, Pa. 16001

[21] Appl. No.: 621,173

[22] Filed: Jun. 15, 1984

[51] Int. Cl.[4] ..... F41G 1/00; F41B 5/00

[52] U.S. Cl. ..... 33/265

[58] Field of Search ..... 33/265

[56] References Cited

U.S. PATENT DOCUMENTS

| | | | |
|---|---|---|---|
| 2,767,472 | 10/1956 | Kocur | 33/265 |
| 3,027,648 | 4/1962 | Crook | 33/265 |
| 3,822,479 | 7/1974 | Kowalski | 33/265 |
| 3,871,105 | 3/1975 | Brougham | 33/265 |
| 4,462,163 | 7/1984 | Tentler et al. | 33/265 |

*Primary Examiner*—Harry N. Haroian

*Attorney, Agent, or Firm*—Clifford A. Poff; Thomas H. Murray

[57] ABSTRACT

A bow sight for facilitating the aiming of an arrow including a sighting pin carrier which is movable longitudinally of an elongated frame to position sighting pins carried thereby at selected elevations corresponding to selected target ranges, each carrier being able to carry an assembly of plural sighting pins arranged in side-by-side relationship and each carrier being selectively rotatable to move the sighting pin or pins carried thereby to a sighting position or an out (non-use) position; the carriers being securable by lock means to lock selected sighting pins in either the sighting or the out-position without restricting movement of the sighting pins longitudinally of the frame; and pin guard means for protecting the sighting pins from impact damage and for carrying range markers to assist in positioning the sighting pins at a desired elevation.

13 Claims, 5 Drawing Figures

ARCHERY BOW SIGHT

BACKGROUND OF THE INVENTION

This invention relates generally to bow sights for use by archers in achieving accurate, consistent shooting. More particularly, the invention relates to a bow sight having a novel sighting pin supporting and positioning structure to permit easy conversion of the sight from user-preferential configurations to configurations required for compliance with the rules of certain competitive shooting events. The invention additionally contemplate a novel sighting pin guard and novel structure for carrying range markers, among other features.

In preparing to shoot, an experienced archer will always nock an arrow at the same point on the bow string, draw the bow so that a particular portion of the hand consistently contacts a particular portion of the head, and then elevate or lower the head of the arrow. This procedure assures that the feathered end of the arrow will always be substantially at the same relative position with respect to the eye of the archer such that the only variable affecting the aiming of the shot will be the distance between the target and the archer.

Some archers aim the bow by intuition. Others employ a bow sight to sight or aim the arrow at different ranges. A bow sight may be provided with a single sighting element which is movable along a track extending substantially parallel to the undrawn bow string. The track for the sighting element typically will extend above the arrow rest of the bow and the sighting element is selectively elevated or lowered to a position corresponding to the range or distance over which the arrow travels to the target. For convenience, the sight may have preselected sighting pin position indicators to correspond to a variety of selected ranges. This type of a sight, an example of which is disclosed in U.S. Pat. No. 2,998,652, may not be satisfactory for bow hunting due to the considerable amount of time which is required to loosen the sighting element, locate it in a new position corresponding to the estimated distance to the target and then retighten the sighting element.

Another known bow sight employs a plurality of sighting elements, each of which is spaced above the arrow rest of the bow by a different distance. The archer estimates the range or distance to the target and then selects the particular sighting element whose position corresponds to the selected range. The highest sighting element corresponds to a shorter range while the lowest sighting element corresponds to a longer range. The multiple sighting elements are prepositioned by a trial and error shooting procedure. One example of this type of bow sight is disclosed in U.S. Pat. No. 2,332,080. My U.S. Pat. No. 3,310,875 discloses an archery bow sight having a plurality of sighting elements which are individually movable between an out position away from the archer's line of sight and a sight-position wherein they extend transversely of the body of the bow and can be utilized for aiming the bow. The plural sighting elements are prepositioned by trial and error on a carrier member to correspond to a respective plurality of different ranges.

Another archery bow sight is disclosed in my U.S. Pat. No. 3,579,839 as incorporating a vernier adjustment for fine tuning of the range setting after a sighting element has been positioned at an approximate range position. The vernier adjustment includes a plurality of sighting element carriers threadedly received on a lead screw such that the sighting element carriers can be moved upwardly or downwardly as the lead screw is rotated.

Still another archery bow sight is disclosed in my U.S. Pat. No. 3,822,479 as incorporating an adjusting means for each of a plurality of sighting elements mounted on a lead screw. Each element thus can be moved along the lead screw independently of other sighting elements thereon. Rotation of the lead screw moves all of the sighting elements in unison and a resilient retention means releasably holds each sighting element selectively in a sighting or an out-position.

SUMMARY OF THE INVENTION

The present invention provides a bow sight having a novel sighting pin support and guard structure which is compatible with the bow and other bow sights to permit, among other benefits, a simple conversion between user-preferential sighting pin configurations and certain mandatory configurations which are required for compliance with the rules of certain competitive shooting events.

Another aspect of the invention concerns a novel sighting pin guard and novel structure for support of range markers.

More specifically, the invention in its presently-preferred form contemplates one or more sighting pin carriers mounted for selective traverse longitudinally of a lead screw to selected range positions, and for rotation about the lead screw between respective sighting and out-positions. A rod passes through the carrier or carriers parallel to the lead screw and is anchored to the bow sight frame to secure the sighting pins carried by the respective carriers in a sighting configuration for compliance with bow sight requirements of certain competitive shooting events, (e.g., bow sights used in bow hunting competition must have four sighting pins fixed in the line of sight of the archer). The invention also contemplates a sighting pin carrier structure which permits a single lead screw-driven carrier to carry multiple sighting pins. This affords numerous advantages including the enhanced ability to employ a motorized lead screw drive. By reducing the number of carriers required, the mechanical drag in lead screw operation is reduced and a consequent reduction in drive motor torque requirements is realized. Additionally, the particular mounting for multiple sighting pins on a single carrier permits relative adjustment of the spacing between the commonly-carried sighting pins to even very small spacing which would not be possible if each pin were mounted on a separate carrier.

The invention further contemplates a novel multi-position sight pin guard which is compatible with the above and other bow sights to protect the sighting pins from damage due to inadvertent forceful contacts. The sighting pins of bow sights typically have been exposed to such contacts and subject to consequent damage. The invention also contemplates a novel range marker structure which is compatible with the above and other bow sights in common with use of the above-mentioned sighting pin guard.

It is, therefore, a general object of the invention to provide a novel and improved archery bow sight.

A more specific object of the invention is to provide a bow sight with novel sighting pin support and adjustment structures which permit ready conversion between certain fixed and movable sighting pin modes of use and provide for increased freedom of range preselection within a narrow range spectrum.

Another object of the invention is to provide a novel sighting pin guard and range marker assembly for a bow sight.

These and other objects and advantages of the invention will be more readily understood upon consideration of the following detailed description and the accompanying drawings, in which.

Figure 1:
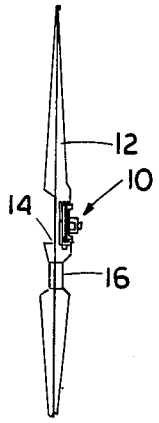
FIG. 1 is a front elevation of a bow with a bow sight of the instant invention.

There is generally indicated at 10 in FIG. 1, a bow sight constructed according to one presently-preferred embodiment of the instant invention and shown mounted on an archery bow 12 to extend generally above an arrow rest 14. Both the arrow rest 14 and tne bow sight 10 are located above the hand grip 16 of the bow 12 such that the archer, when positioned to shoot with the bow held by hand grip 16, is sighting along a line of sight which is generally parallel to the arrow and which intersects a sighting element of bow sight 10.

Figure 2:
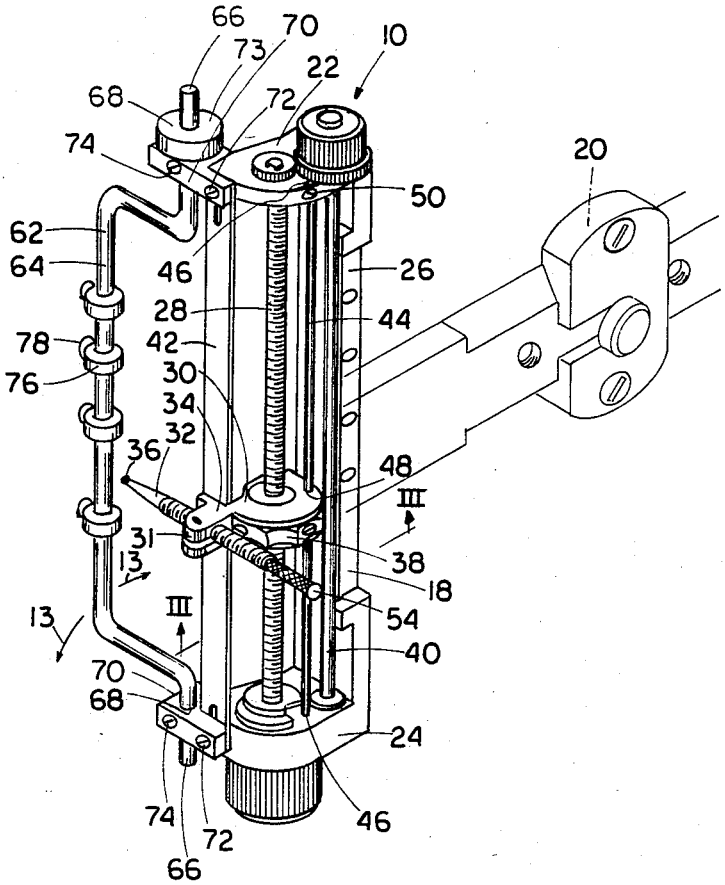
FIG. 2 is a perspective view of a bow sight of the instant invention.
Figure 3:
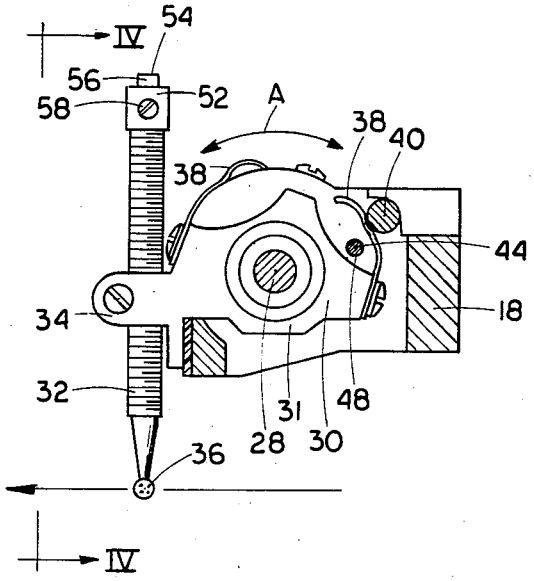
FIG. 3 is a sectional view taken on line III—III of FIG. 2 and showing a novel sighting pin support according to the present invention.

More specifically, and with reference to FIGS. 2 and 3, bow sight 10 includes a rigid frame 18 mounted on an elongated rigid mounting bracket assembly 20 which is, in turn, fixedly secured to bow 12 and extends forwardly therefrom. Frame 18 includes upper and lower end portions 22, 24 which are integral with an elongated intermediate portion 26 extending therebetween. A lead screw assembly 28 extends vertically between end portions 22 and 24, and carries thereon a sighting element 31 including a sighting pin carrier 30. Carrier 30 is actuated by action of lead screw assembly 28 to travel longitudinally of the bow sight 10 intermediate frame end portions 22, 24. The sighting element 31 thus is selectively adjustable to different elevations along the vertically-extending frame 18.

Carrier 30 carries an elongated sighting pin 32 in a threaded screw clamp portion 34 thereof such that the sighting tip 36 of sighting pin 32 is able to be transversely adjusted for windage. The sighting assembly 31 also is selectively rotatable about lead screw 28, as shown by arrow A in FIG. 3, between a sighting position, as shown in FIG. 2, whereat the sighting tip 36 is positioned in the archer's line of sight, and an out-position whereat the sighting tip 36 is removed from the line of sight of the user. The carrier 30 includes spring-bias detent elements 38 which cooperate with a guide rod 40 that extends parallel to lead screw 28 and is secured with respect to frame 18. The assembly 31 thus may be retained by spring bias in either the sighting or the out-position.

In the sighting position, as shown, the screw clamp portion 34 of carrier 30 laterally overlaps and contacts a vertically-extending scale and guide member 42 having a scale surface whereon the archer may permanently indicate either selected positions for sighting assembly 31 corresponding to different ranges, or preselected positions for adjustable range markers which will be described hereinbelow.

Of course, it will be appreciated that the bow sight 10 may carry more than one of the sighting assemblies 31 at vertically-spaced locations along lead screw 28.

Inasmuch as bow sights of the above-described type are well known in the art, further detailed description thereof is believed to be unnecessary for an understanding of the present invention. Additional detailed description of such bow sight structures as described hereinabove is included in the above-cited U.S. Pat. No. 3,822,479, the entire disclosure of which is made a part hereof and incorporated herein by reference.

Referring further to FIGS. 1 and 2, a selectively-removable lock rod 44 has its longitudinal ends releasably secured within apertures 46 in frame end portions 22, 24 such that the rod 44 extends parallel to lead screw 28 and guide rod 40 passes through a respective aligned through aperture 48 in each carrier 30. At least one of apertures 46 is a through opening to facilitate removal and insertion of lock rod 44. When rod 44 is installed, as shown, and secured as by one or more setscrews 50 in frame ends 22 and 24, the assemblies 31 are free to travel longitudinally of frame 18 along lead screw 28, but may not be rotated thereabout. Preferably, the aperture 48 in each carrier 30 is located in alignment with apertures 46 to receive rod 44 when the sighting assembly 31 is in the sighting position. Thus, installation of the rod 44 provides selective conversion for compliance with competitive shooting rules which require a given number of fixed sighting pins.

Of course, each carrier 30 may, if desired, have two apertures 48, one each corresponding to the sighting position and the out-position. Thus, with the rod 44 installed, selected ones of a plurality of sighting elements 31 may be fixed in the sighting position while others may be fixed in the out-position, according to the sighting element position selected prior to lock rod installation. Of course, with rod 44 removed, the user is free to move sighting elements 31 at will between the sighting and out-positions.

A certain amount of rotary free play may be observed in sighting elements 31 even with lock rod 44 installed due to the necessary clearance between rod 44 and respective apertures 48 and the possible bending of unsupported central portions of the rod 44. Thus, even with the inclusion of lock rod 44, the spring-biased contact of detent springs 38 with guide rod 40 is not redundant as it serves to provide precise biased retention of the sighting element in either the sighting or the out-position.

Figure 4:
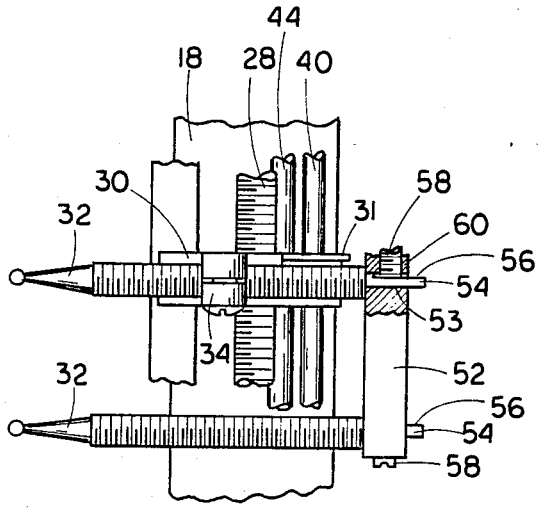
FIG. 4 is a side elevation taken on line IV—IV of FIG. 3.
Figure 5:
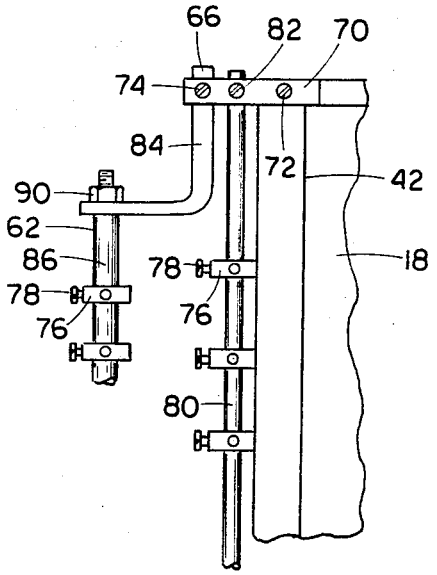
FIG. 5 is a fragmentary front elevation of a bow sight similar to that shown in FIG. 1.

Referring to FIGS. 4 and 5, another aspect of the invention will be seen to reside in the provision of a "piggy-back" sighting pin support arrangement wherein one or more sighting element assemblies 31 include a plurality of sighting pins 32, preferably two, releasably secured together in side-by-side relationship by a connector 52. The connector 52 is preferably an elongated rigid bar having a pair of parallel, spaced-apart through openings 53 which receive the shank end portions 54 of a pair of the sighting pins 32. Each shank portion 54 is provided with a flat 56. A setscrew 58 extends within a tapped blind bore 60 in connector 52 to intersect bore 53 whereby the setscrew 58 is engageable with flat 56 to rigidly secure the respective sighting pin 32.

As one of the sighting pins 32 is secured by screw clamp portion 34 of the carrier 30, the connector 52 couples a pair of sighting elements together and thereby permits each carrier 30 to support a pair of sighting pins 32. Furthermore, by rotating the connected pair of sighting pins about the axis of the pin 32 secured in screw clamp portion 34, the vertical spacing between the adjacent pins 32 may be continuously adjusted from a maximum spacing as shown in FIG. 4, to a virtually nil spacing. Thus, even the smallest increment of pin elevation, which corresponds to target range, may in theory be accounted for by preselection of the relative vertical spacing between a pair of connected pins 32. This would not be possible if each pin 32 were secured by a separate carrier 30 since physical interference between the adjacent carriers would establish a minimum vertical spacing, and a corresponding minimum range differential, between the respective adjacent pins 32.

Of course, the above-described piggyback sighting pin arrangement is compatible with all other above-described features of both the invention, and conventional bow sights. For example, the piggyback pins are movable in unison longitudinally of frame 18 by action of lead screw 28. Further, they may be rotated in unison between sighting and out-positions, and may be secured in either position by installation of lock rod 44 as above described.

A further aspect of the invention is shown in FIGS. 2 and 5 as an adjustable sighting pin guard assembly 62 which includes a formed, generally angular pin guard element 64 which extends laterally outward of the sighing tips 36 of pins 32 to thereby encompass the space into which they project. The pin guard element 64 includes axially-aligned end portions 66 which are received in through apertures 68 formed in a pair of mounting blocks 70. One mounting block 70 is rigidly secured to each of end portions 22, 24 of frame 18 as by a machine screw 72. A support collar 73 is secured by a setscrew to the upper end portion 66 for holding the guard element 64 at a predetermined elevation with respect to the sight tips while the guard element is rotatably positioned on the sight. The collar is also used to establish and hold the low bent leg part thereof at an elevation with respect to the mark so that the broad head arrow, for example, can pass beneath the guard.

Setscrews 74 are provided in mounting blocks 70 to secure pin guard 64 in a selected rotary position, for example the position shown in FIG. 2. The pin guard 64 similarly may be positioned and secured in any rotary position within the range of rotary motion thereof about the axis of guard end portions 66 as indicated by arrows 13. For example, when sighting pins 32 are in the out-position, the guard 64 may be rotated from the position shown to a position adjacent the otherwise unprotected sighting tips 36.

In yet a further aspect of the invention, each of a plurality of color-coded range markers 76 may be secured as by a setscrew 78 to guard 64 of preselected locations corresponding to different ranges. The vertical juxtaposition of a sighting pin with a given range marker would thus assist the archer in quick sighting pin adjustment and selection. In an alternative embodiment of this aspect of the invention, a range marker carrier rod 80 may be secured in mounting blocks 70 as by set-screws 82. The color-coded range markers 76 may be received upon rod 80 and secured thereto in the same manner as on pin guard 64. The range markers may be installed on either or both of rod 80 and pin guard 64.

In order to facilitate installation of range markers on pin guard 64, the guard 64 may be comprised of angular end portions 84 (FIG. 5) incorporating ends 66 and to which an elongated marker carrying portion 86 is selectively releasably secured as by threaded fasteners 90. Thus, the range markers 76 may be installed or removed on pin guard 64 without need of passing the markers over the angular bends in the pin guard 64.

According to the description hereinabove, the instant invention provides a novel and improved bow sight. Although the description relates to specific, presently-preferred embodiments of the invention, it is to be appreciated that the inventor contemplates various modified and alternative embodiments other than those described. Accordingly, it is intended that the invention be construed as broadly as permitted by the scope of the claims appended hereto.

I claim as my invention:

1. A bow sight adapted to be mounted on an archery bow to facilitate aiming of an arrow comprising:

an elongated frame, selectively operable traversing means carried by said frame, at least one sighting element carrier cooperable with said traversing means to traverse the length of said frame, sighting element means carried by said at least one carrier and movable therewith longitudinally of said frame to selected sighting element elevations, means for releasably holding said sighting element means for selective movement between a sighting position in the line of sight of the user and an out-position out of the line of sight of the user, and lock means selectively cooperable with said at least one carrier independently of said means for releasably holding said sighting element means for positively securing said sighting element means in a preselected one of said sighting and said out-positions throughout longitudinal traverse of said frame by said carrier.

2. The bow sight of claim 1 wherein said at least one carrier is one of a plurality of carriers which cooperates with said traversing means to traverse said frame in unison.

3. The bow sight of claim 2 wherein said traversing means includes an elongated lead screw extending longitudinally of said frame and cooperating with each of said plurality of carriers.

4. The bow sight of claim 3 wherein said sighting element means includes a pair of sighting pins rigidly coupled together in side-by-side relationship.

5. The bow sight of claim 4 wherein one of said pair of sighting pins is affixed to said at least one carrier.

6. The bow sight of claim 5 wherein the other of said sighting pins is selectively movable about the axis of one sighting pin to incrementally adjust the relative elevation differential between said pair of sighting pins.

7. The bow sight of claim 6 wherein said lock means includes an elongated lock rod selectively secured with respect to said frame and extending parallel to said lead screw and through a locking aperture of each of said carriers to positively secure said carriers against rotation with respect to said frame about said lead screw.

8. The bow sight of claim 7 additionally including spring-biased detent means for retaining said carriers in said sighting or said out-position by restricting rotation of said carriers about said lead screw independently of said lock rod.

9. In a bow sight for facilitating the aiming of an arrow which comprises multiple sighting pins carried by pin carriers which are mounted on an elongated frame and are movable longitudinally of the frame to selected positions corresponding to selected target ranges, the improvement comprising:

means for coupling together at least a pair of said sighting pins in adjacent side-by-side relationship while the pins are carried by a single pin carrier in a manner that the relative position of said pair of sighting pins with respect to each other is continuously adjustable independently of movement of the pin carrier longitudinally of the frame between a relative position corresponding to a given maximum range differential therebetween and a relative position corresponding to a nil range differential therebetween.

10. The improvement of claim 9 wherein only one sighting pin of said pair of sighting pins is engaged by a carrier.

11. In a bow sight for facilitating the aiming of an arrow which comprises multiple sighting pins carried by pin carriers which are mounted for longitudinal traverse of an elongated frame to position the sighting pins at selected elevations corresponding to selected target ranges, and for movement between a sighting position and an out-position of each of said sighting pins, a pin guard assembly comprising:

a pair of mounting blocks secured adjacent opposite ends of said frame, a generally angular, elongated guard member carried by said mounting blocks to extend adjacent said sighting pins, said guard member being pivotal with respect to said mounting blocks to maintain a selected position thereof adjacent said sighting pins whether said sighting pins are in said sighting position or said out-position, and securing means cooperable with said mounting blocks to selectively secure said guard member in any selected pivotal position thereof.

12. The pin guard assembly of claim 11 additionally including range marker means carried by said guard member and selectively movable thereon longitudinally of said frame.

13. The pin guard assembly of claim 11 additionally including range marker means carried by a carrier member which extends longitudinally of said frame between said mounting blocks and is secured to said mounting blocks.

* * * * *